US011142287B2

(12) United States Patent
Jørgensen et al.

(10) Patent No.: US 11,142,287 B2
(45) Date of Patent: Oct. 12, 2021

(54) SYSTEM AND METHOD FOR COMPENSATION OF MOTIONS OF A FLOATING VESSEL

(71) Applicant: Skagerak Dynamics AS, Kristiansand S (NO)

(72) Inventors: Andreas Krossen Jørgensen, Kristiansand S (NO); Pawel Slawomir Sliwa, Kristiansand S (NO)

(73) Assignee: Skagerak Dynamics AS, Kristiansand S (NO)

( * ) Notice: Subject to any disclaimer, the term of this patent is extended or adjusted under 35 U.S.C. 154(b) by 116 days.

(21) Appl. No.: 16/466,059

(22) PCT Filed: Dec. 4, 2017

(86) PCT No.: PCT/NO2017/050314
§ 371 (c)(1),
(2) Date: Jun. 3, 2019

(87) PCT Pub. No.: WO2018/106120
PCT Pub. Date: Jun. 14, 2018

(65) Prior Publication Data

US 2020/0070935 A1 Mar. 5, 2020

(30) Foreign Application Priority Data

Dec. 5, 2016 (NO) ..... 20161938

(51) Int. Cl.
*B63B 3/48* (2006.01)
*E02B 17/08* (2006.01)

(52) U.S. Cl.
CPC ..... *B63B 3/48* (2013.01); *E02B 17/0809* (2013.01); *B63B 2003/485* (2013.01)

(58) Field of Classification Search
CPC .. B63B 3/48; B63B 2003/485; E02B 17/0809
(Continued)

(56) References Cited

U.S. PATENT DOCUMENTS 3,390,654 A 7/1968 Bromell et al.
RE27,261 E * 12/1971 Bromell ..... B63B 29/12 114/264
(Continued)

FOREIGN PATENT DOCUMENTS

EP 0390728 A2 10/1990
GB 2432174 B 11/2009
(Continued)

OTHER PUBLICATIONS

International Search Report and Written Opinion dated Mar. 23, 2018 (PCT/NO2017/050314).

*Primary Examiner* — Matthew R Buck
*Assistant Examiner* — Patrick F Lambe
(74) *Attorney, Agent, or Firm* — Alix, Yale & Ristas, LLP

(57) ABSTRACT

Systems and method for compensation of motions of a floating structure, which includes a lifting system with a working platform supported by its actuators driven along vertical axis, where the foremost and the aft-most units are paired with each other providing a self-leveling movement; and a balance system, which can freely deviate from its position relative to the deck, with its own actuators and which is arranged to at least one side of the working platform, providing an even distribution of weight enabling the working platform to remain upright and steady, regardless of the floating structure. The lifting system is associated with the balance system by the plurality of arrangements of motion units, which assure the substantially constant angle between the working platform and the working frame, providing free linear movement relative to the working frame regardless of the base structure and the floating structure.

18 Claims, 4 Drawing Sheets

(58) Field of Classification Search
USPC ..... 166/355
See application file for complete search history.

(56) References Cited

U.S. PATENT DOCUMENTS

| | | | | |
|---|---|---|---|---|
| 3,917,006 | A | 11/1975 | Kellner | |
| 5,947,740 | A | 9/1999 | Kim | |
| 6,561,112 | B1 | 5/2003 | Benson et al. | |
| 6,929,071 | B2 | 8/2005 | Moncus et al. | |
| 8,613,322 | B2 * | 12/2013 | Coles | E21B 19/22 166/355 |
| 9,051,783 | B2 * | 6/2015 | Croatto | E21B 19/006 |
| 9,340,263 | B2 | 5/2016 | Koppert | |
| 2014/0014015 | A1 | 1/2014 | Roodenburg et al. | |
| 2015/0375836 | A1 | 12/2015 | van der Tempel et al. | |
| 2016/0068236 | A1 | 3/2016 | van der Tempel et al. | |
| 2017/0074056 | A1 * | 3/2017 | Roodenburg | E21B 19/07 |
| 2017/0341716 | A1 * | 11/2017 | Roodenburg | B63B 35/03 |
| 2017/0341717 | A1 * | 11/2017 | Roodenburg | B63B 35/4413 |

FOREIGN PATENT DOCUMENTS

| | | | |
|---|---|---|---|
| WO | 2004013452 | A1 | 2/2004 |
| WO | 2011008835 | A2 | 1/2011 |
| WO | 2011133552 | A1 | 10/2011 |
| WO | 2013180564 | A1 | 12/2013 |

* cited by examiner

SYSTEM AND METHOD FOR COMPENSATION OF MOTIONS OF A FLOATING VESSEL

BACKGROUND

The disclosure relates to a system and a method of stabilizing a working platform arranged on a floating structure.

Additionally, the instant disclosure relates to a motion compensation system installed on a floating structure, which provides a stable, actively or passively operated platform that moves regardless of the deck to ensure a stable performance of operations during offshore activities.

More particularly, a system is disclosed which comprises:

a set of mechanical components including at least: a self-leveling working platform; a working frame for an even distribution of weight enabling the working platform to remain upright and steady; a base structure; a plurality of arrangements of motion units for linear movement relative to the working frame, which provide a substantially constant angle between the platform and the frame; and joints between the parts to allow multidirectional movement relative to desirable axes;

a set of separated actuator systems for compensation and balance respectively, to control the displacement within rotational and vertical movements of the system regardless of the floating structure;

a set of sensor systems to determine the behavior of a structure, and supervised by a control system that drives signals as a response to the given measurements.

The disclosed system may comprise an additional system, e.g. an active heave compensator, integrated with the present one to reduce the rest movement even further. The assembly may comprise additional devices in order to compensate the motion of a structure and to sustain the position of the working platform in terms of performed activities and demand. Also disclosed is a method for utilizing the disclosed system.

It is well known that the irregularity of wave patterns causes disturbances impacting operability and performance of floating vessels. The undesirable action of inertial forces together with shifts in the direction of gravity of the floating structure affect the precision of operation. Rapid changes in movement of the compensation system are required with regards to gravity.

All the various activities performed on offshore vessels, related to oilfield and maritime operations as well as harbor engineering services, or offshore energy exploration activities are subject to the safety rules and must meet certain requirements depending on the application. Whether it is a cargo or multi-purpose ship, offshore oil vessels such as drilling rigs or supply boats, some operations would benefit from a deck area which remains stable under changeable environmental conditions. The range of activities at sea associated with drilling, well intervention, P&A, assembling, maintenance, repair, painting, lifting, conveyance or transferring, depends to a large extent on the vessel type, and more specifically from its response to sea waves and the systems installed onboard responsible for compensation of wave-induced motions.

It is well known, that small waves can induce large motions of lighter floating structures when a larger structure is near [5], [6]. Smaller vessels are prone to such response, and their compensation systems require high efficacy in order to avoid and/or minimize the results of surrounding conditions.

Large dynamically positioned drillships have their operational efficiency comparable with semisubmersible drilling rigs. The behavior of smaller units due to wave motion does not give satisfactory results in terms of the motion transfer functions (pitch, roll and heave are significant for high sea states), compared to large dynamically positioned vessels.

In drilling, many proven compensation systems on the market use a crown mounted compensator and a riser string compensator for heave motion compensation. Drill-string compensation system affects the derrick size, increasing its weight and height, hence those systems have detrimental effect on stability.

The well proven active heave motion compensating drawworks have good characteristics primarily in conditions of moderate environmental loads and large size vessels. For smaller size drillships, the motion behavior remains unsatisfactory. Whether it is a passive or active compensation system, additional installation of equipment is necessary. Thus, the occupied space increases as well.

The difference in the behavior of compensation cylinders under the action of static and dynamic forces can lead to significant variations in the response of these cylinders since the static forces introduce additional position errors. The motion of a ship creates the load changes for the compensation system. The disadvantage is that the system cannot react properly when those changes have similar values to the static friction of compensation cylinders. The leading systems on the market offer residual motion slightly less than 10%, an essential value in terms of riser string tension.

For smaller drillships, the location of moon pool is dependent on ratio of displacement to the product of length, width and draft, so called: block coefficient. The total weight of the derrick mounted above the moon pool plays significant role with regards to stability when compensating vertical and rotational movements as mentioned above. To minimize the heave amplitude on the drill floor, the location of moon pool must be at the point where the effect of combined heave and pitch is as minimal as possible.

Several invention patents relating to the moon pool have been issued, such as U.S. Pat. No. 6,561,112 issued to Benson, et al. The Benson's invention presents an independent moon pool platform deployed within the existing moon pool of a vessel, hence the motion of vessel is compensated too.

The system disclosed in EP 0 390 728 A2 patent relates to damping of the heave of floating structures, where a damping system is coupled to the tensioner system, varying tension and exerting damping forces on the floating rigs. This invention relates to semisubmersible platforms.

An example of invention regarding a motion compensation system is disclosed in Coles U.S. Pat. No. 8,613,322, describing an active compensation system for motion encountered during intervention operations.

Another example of active heave compensation system is disclosed in Roodenburg et al. US 2014/0014015 A1. The invention assumes the use of a motor generator and an electrical storage element, whilst the motor generator drives the loads and then regenerates the energy (stored in electrical element) from the heave motion cycle. The Roodenburg's et al. invention is an alternative to the well known active compensation systems which are hydraulic/gas pressure based. The disadvantage of such systems is their complexity which requires a costly system with regular and frequent maintenance intervals since there is a risk of leakage of hydraulic fluid causing environmental damages.

Croatto presented a vessel for various activities, which consists of the main deck mounted with a compensation unit, and another deck elevated above the moon pool. The compensation unit is designed to be multi-purpose, having bigger range of compensation compared with the known systems, and it may operate in a variety of operations, i.e. as an elevator when the carrier is disconnected from wellhead. The invention is disclosed in U.S. Pat. No. 9,051,783.

The invention related directly to the drill floor was disclosed in 1975 in Kellner U.S. Pat. No. 3,917,006. The floor level motion compensator pertains to rotary method for drilling wells from a floating vessel. This is a hydraulic cylinder-based method, where the cylinder is integrated with the driving joint of a drill-string and activated after measurement of load or fluid pressure, as a response to the drill-string tension.

Another motion compensation carrier frame which may be combined for instance with gantry cranes for transferring loads from a vessel to other construction, is disclosed in Koppert's U.S. Pat. No. 9,340,263.

A system for motion compensation, wherein a deck is attached to the riser and a sliding frame, is disclosed in Moncus et al. U.S. Pat. No. 6,929,071. The invention assumes that the system comprises a frame on the platform, with plurality of guides, and cylinders, which are driven by pneumatic means supplied by a recharging vessel and a gas delivery mechanism.

In 1965 D. Stewart presented a motion platform with six degrees of freedom (6DoF) for use in aerospace industry as a flight simulator. The Stewart platform consists of six linear actuators connected between a rigid top and base frames, enabling movement of those two frames in six degrees of freedom. The design was a modification of octahedral hexapod by Klaus Cappel disclosed in 1964 and the patent was granted in 1967.

One of the modern inventions based on the principle of Stewart platform is disclosed in Kim's U.S. Pat. No. 5,947,740. This system includes a base plate and a platform connected to each other by six hydraulic actuators with one additional vertically positioned actuator for weight supporting, located in the middle of the system. The invention relates to a cockpit model for training driving of a car.

The Stewart platform was adapted to offshore wind industry to access the wind turbines, enabling transferring of personnel from a service vessel. The adaptation of that system is disclosed in Van der Tempel et al.'s US 2014/0311393 A1, as well as US 2015/0375836 A1, and US 2016/0068236 A1. The size of the system introduced on the market depends on the type of vessel. The main assumption of the system is to provide a safe transferring of personnel and maintenance equipment from the vessel to the wind turbine. The intention is to place the system on rather smaller vessels, i.e. a supply vessel, hence the compensation platform must have minimal dimensions to be taken into account when designing. The load capacity is then limited too. The motion compensated platform has a gangway for personnel to walk through. The idea of the method of compensation is to drive the actuators to hold at least one carrier stationary in relation to the other element in the area that surrounds the vessel. The system consists of a pneumatic element to act against the gravitational force.

It is noticed that in WO 2011/008835 A2, a stabilization system for a self-supporting riser for downhole intervention is described. That system comprises a platform supported by cylinders, guide rails in order to prevent racking of those cylinders, as well as a frame preferably suspended on other cylinders below the platform, for pitch and roll stabilization. The vertically positioned cylinders for the platform are perpendicular to the vessel's deck, hence the platform remains parallel to the deck. These cylinders stabilize heave only and they all together move upwards and downwards, thus they can be mounted rigidly to the vessel. The cylinders for pitch and roll stabilization are attached to both the platform and the frame, hence the range of inclination of these cylinders is limited due to structural restraints. The hydraulic circuit for pitch and roll cylinders is a passive system with fixed volume of fluid.

It is also noticed that in WO 2013/180564 A1, a gangway supported by a 2-degrees-of-freedom hinged column is described. The column is set on a hinge connection with the same principle of its operation as a universal joint, or the commonest a Hooke's joint. This joint with two pivot pins with a 90 degrees angle enclosed between them, allows the column to rotate relative to the vessel and it can transmit heavy loads with quite large angle misalignment. As described in the document, one pivot pin is in the bracket fixed to the vessel, while the other one is connected to a turntable with a rotatable ring connected to the end part of the column. The fixed ring, in relation to which the rotatable one moves, has two lever arms where hydraulic cylinders are connected. Since the intention is to maintain vertical position of the column, the hydraulic cylinders mounted between the vessel and the lever arms are operated towards desired length (lengthened or shortened) as a response to direction of rolling and pitching movements. The hinge connection with the turntable allow the column (which is set on it) to swivel around the two horizontal pins and to swing towards different directions, giving a 3-degrees-of-freedom mechanism.

GB 2432174 B also published as US 2007/0107900 A1, describes a delivery system for downhole use which comprises a motion compensator. The platform there slides on four vertical beams which are supported rigidly by a frame. The movement up and downwards is maintained by a scissor mechanism and driven by hydraulic cylinders. The scissor mechanism raises the platform keeping it perpendicular to the vertical beams; hence it has the same horizontal position relative to the deck of the vessel. The hydraulic cylinders may either work as passive, acting as dampers, or there might be added two cylinders additionally, charged by an active system, for instance for retracting the platform.

In WO 2004/013452 A1, a two-part riser tensioning device is disclosed. A first part contains hydraulic cylinders connected between the riser and a displaceable frame. Another set of hydraulic cylinders is associated between the displaceable frame and the vessel. The displaceable frame, so called intermediate frame, has four guide bearings to provide vertical movement along guides in the vessel structure. This frame is provided with a mechanism arranged as suspended from the vessel structure. In such arrangement, a horizontal displacement is limited by the vessel structure and the lateral forces are mostly taken by the hydraulic cylinders and the vessel structure.

Another riser tensioning system is disclosed in WO 2011/133552 A1. This system as well comprises a plurality of inclined to the center axis hydraulic cylinders for controlling the vertical position of the riser. A transfer of lateral loads is taken by a gimbal mechanism comprising two rings mounted together on perpendicular axes, and acting between the platform and the riser, which may tilt in relation to the platform. A torque transfer from the riser occurs through components between the tensioning ring, gimbal mechanism and the platform. Such inclination in the arrangement of cylinders seems to refer to the Stewart platform.

SUMMARY

The presented prior art in the field of compensation of motion at sea gives opportunities for individual selection with regards to the application. The commonly used principle of operation for such systems is a cylinder-based solution. Taking into consideration a wide variety of applications, the polygonal platforms may serve as the most universal ones. However, this particular arrangement of actuators requires a significant increase in the size of actuators when large movements are to be considered. This is not only with regards to the physical limitations in performance, but it entails an increase in power supply and additional space to be provided for the size of equipment. Many inventions assume the use of a weight supporting actuator located centrally under the carrying platform, which in turn may interfere with the location of the operating equipment used in particular processes, e.g. drilling. Another issue is the arrangement of the carrier platform which in most cases is provided with constant angle relative to the deck of the vessel. This, in result, requires yet another platform to be arranged, in order to carry personnel safely. The other systems can be utilized to provide stabilization of the carrying platform, but they still require another large system to compensate the movements, even though with unsatisfactory results with regards to demands of modern technology.

The disclosed embodiments remedy or reduce at least one of the drawbacks of the prior art, or at least provide a useful alternative to prior art.

Moreover, it would be desirable to provide a system that would be suitable for vessels with unsatisfactory characteristics of motion with regards to the sea states, to improve their performance and enhance their efficiency towards modern technologies.

It would also be desirable to provide a novel system that could increase and ensure safe operations, transportation or any other means during its use.

The disclosed system keeps a substantially level working platform in a desired position, said working platform being arranged movable to a floating vessel or floating structure, wherein a set of elongate lifting actuators are connected pivotal to a base structure and to the working platform via numerous pivotal joints to compensate for pitch, roll and heave movements imposed by the floating vessel or structure, wherein the system further comprises sensor means to record pitch, roll and heave movements.

The system further comprises a working frame which in one embodiment may have a first upper end fixed to the working platform and a second lower end connected movable to the base structure by a set of balance actuators and a pivotal joint, said actuators and pivotal joint are arranged to tilt the working frame in a desired angle to compensate for movements imposed by the floating vessel or structure and maintain the working platform in a desired position.

The working frame comprises in one embodiment a first and second vertical beam and a horizontal beam extending between the first and second vertical beam, and two linear motion units arranged slideably to the respective vertical beams, wherein two actuators of said set of actuators are connected to one of said linear motion units and two further actuators of said set of actuators are connected to the other one of said linear motion units, wherein the horizontal beam is connected pivotal to the base structure about a substantially horizontal axis by a joint arrangement, and further at its respective ends connected pivotal to the linear motion units via pivotal joints.

The balance actuators are typically cylinder pistons driven hydraulically and/or pneumatically by a compressor assembly and supply lines, arranged to tilt the working frame in a desired angle.

The sensor means can comprise two or more pitch sensors and two or more roll sensors arranged at the base structure at the respective sides with respect to the working frame.

The set of lifting actuators comprises first pair of co-operating actuators arranged at a first end of the platform, each actuator in the first pair being arranged at opposite first and second sides of the working platform, and in a similar manner a second pair of co-operating actuators arranged at a second end of the platform, each actuator in the second pair arranged at said opposite first and second sides of the platform, said actuators being connected to the working platform by respective pivotal bearings, and connected pivotal to the base structure by bearings.

In one embodiment, the actuator and the actuator at said first side are connected to a common lower point to the base structure and having their longitudinal axis extending in a mutual angle increasing in direction upward, and similarly the actuator and the actuator at said second side are connected to a common lower point to the base structure and having their longitudinal axis extending in a mutual angle increasing in direction upward.

The actuators are in another embodiment extending substantially vertically and in parallel, and can in any embodiment be realized by cylinder pistons operated hydraulically and/or pneumatically by a compressor assembly and supply lines, arranged to move the working platform in a vertical direction.

According to one embodiment, two separate systems which are provided for balance and lifting with actuators arranged in the triangle-like or parallel configurations with their casings either upwards or downwards, providing a working platform independent of the floating structure. A first side of the platform is provided with a first pair of co-operating actuators arranged at a first end of the platform, each actuator in the first pair being arranged at opposite second and third sides of the platform, and in a similar manner a second pair of co-operating actuators arranged at a second end of the platform, each actuator in the second pair arranged at said opposite first and second sides of the platform. Furthermore, the vertical motion is supported by an arrangement of linear motion components connected with the platform, while the control of the lifting and the balance processes is provided by a control system. The actuators are advantageously operated by hydraulic fluid pressure.

The presented configuration provides control of motion in rotational pitch, roll and vertical heave displacements, providing a working platform independent of the vessel's deck. The design of working frame ensures a substantially constant angle relative to the platform, hence it limits any additional twisting of the construction, but it does not limit the platform in terms of the movement of the vessel. Thus, no additional platform is required. The forces generated by the hydraulic system keep this construction under control in all six degrees of freedom. The movement is controlled by measurements that drive signals to the actuators as a response to the actual displacement of the floating structure and may be used with regards to cargo transportation, or riser string tension on a drilling rig. The present motion compensation system reduces the need for commonly used large systems incorporated with the vessel, hence increasing its stability. The range of motion that can be compensated meets the modern practices for normal and suspended drilling and it may as well be used for transferring personnel, cargo or other activities. The working platform can be lowered for e.g. maintenance and when relocating the vessel.

BRIEF DESCRIPTION OF THE DRAWINGS

The present invention is explained by examples of preferred embodiments which can be utilized in drilling, cargo, subsea construction, mining or educational purposes, with reference to the enclosed drawings, in which.

DETAILED DESCRIPTION

Figure 1:
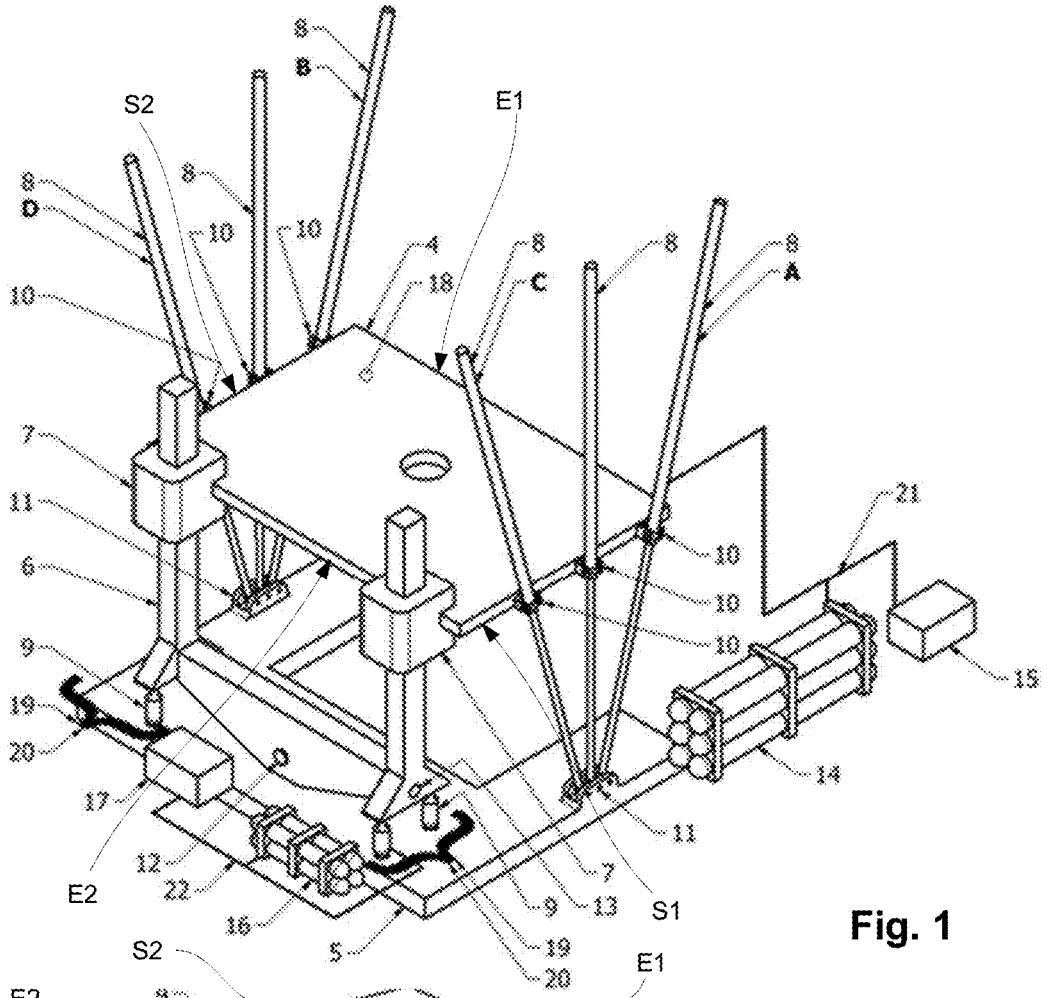
FIG. 1 is a general view of an embodiment of the disclosed system.

In the following, identical reference numerals will refer to identical or similar features in the drawings. The figures are schematic and simplified, and the various features therein are not necessarily drawn to scale.

With reference to FIG. 1 the motion compensated platform includes the working platform 4 designed to remain steady when carrying the loads, the base structure 5 and disposed between them a plurality of lifting actuators 8. The working platform 4 has two linear motion units 7 which cooperate with working frame 6 providing a constant angle relative to said platform 4. The lifting actuators 8 are attached to the working platform 4 and secured by a plurality of bearing joint arrangements 10 which provide pivotal movements of the actuators in relation to the platform. At the other end, those actuators 8 are connected to bearing joint arrangements 11 located on the base structure 5. The arrangement of the working frame 6 with its vertical beams secured by means of pivot joints 13 to the horizontal beam, ensures the substantially constant angle between the working frame 6 and the working platform 4. The horizontal beam of the working frame 6 is attached to a bearing joint arrangement 12 located at approximately midpoint of the edge of the base structure 5. The working frame 6 is stabilized in roll and pitch directions by a set of balance actuators 9 disposed between said frame 6 and the base structure 5.

Figure 2:
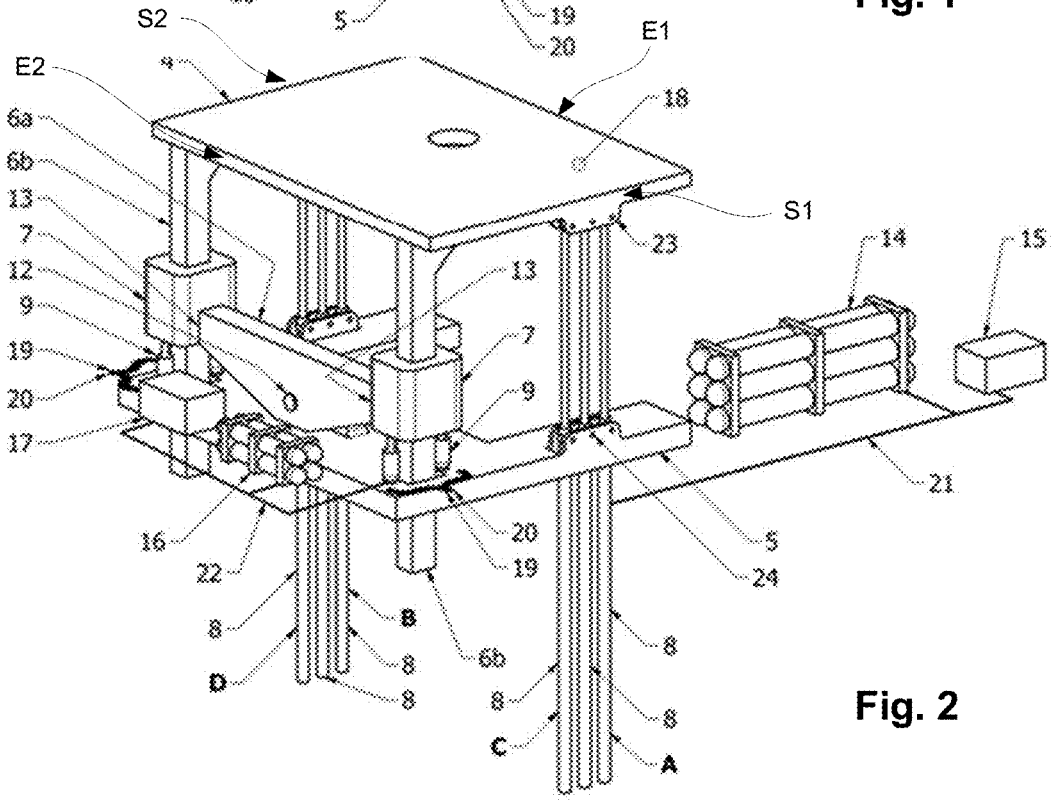
FIG. 2 is a view of the system having parallel lifting actuators 8 with their casings mounted downwards in order to provide the working platform 4 accessible from each side.
Figure 7:
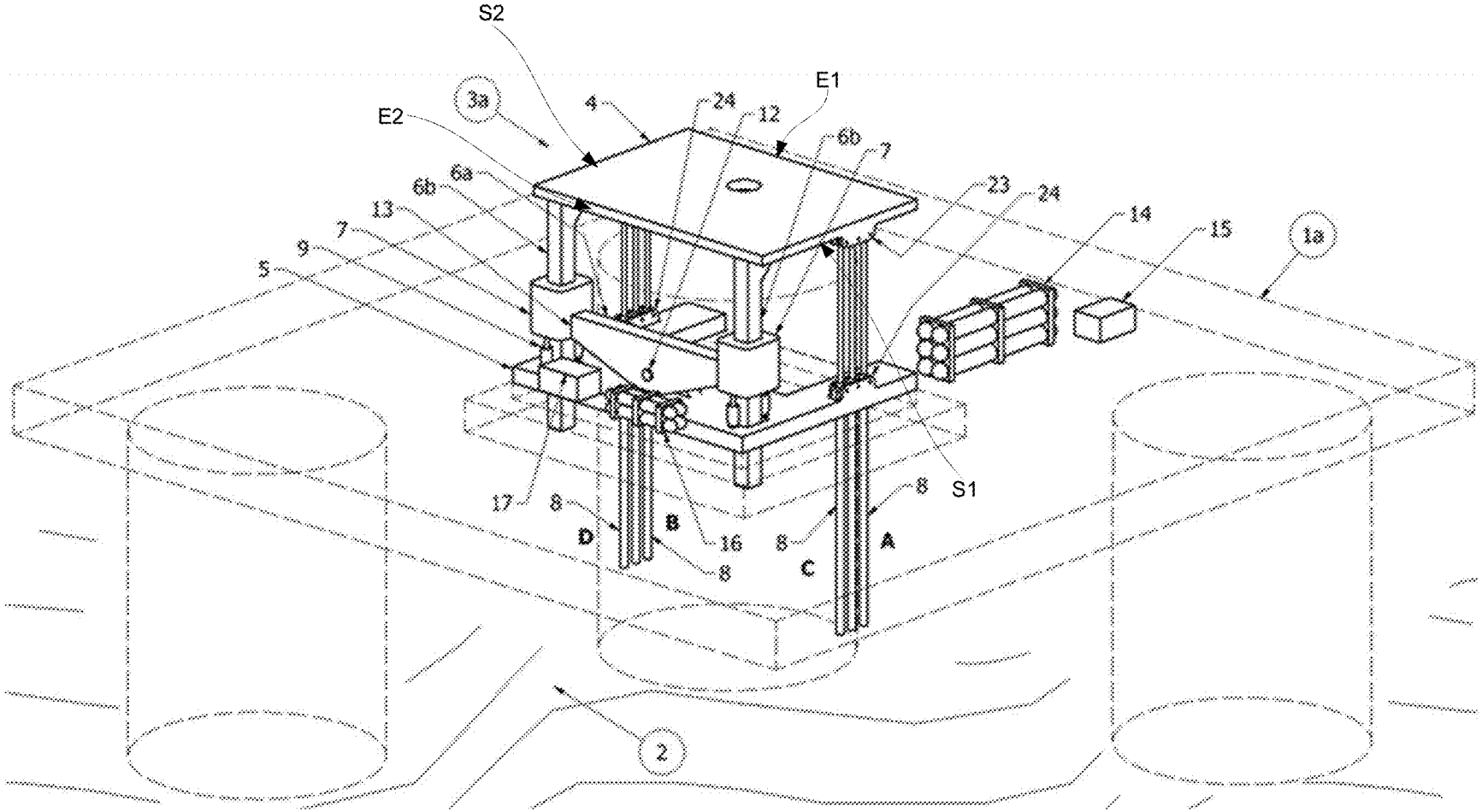
FIG. 7 is a perspective view of one embodiment of the system installed on a floating structure, where the casings of the lifting actuators 8 are mounted downwards.

In one embodiment, the lifting actuators 8 can be mounted with their casings downwards. Referring to FIG. 2 and FIG. 7, such method of installation can be utilized on vessels e.g. semisubmersibles, where a defined space under deck is provided for movements of the lifting actuators 8 and the vertical beams 6*b*. In this particular embodiment, the linear motion units 7 are mounted to the horizontal beam 6*a* by pivot joints 13, whilst the vertical beams 6*b* are rigidly mounted to the working platform 4. The working platform 4 comprises a plurality of bearing joint arrangements 23 for the lifting actuators 8 which are, on the other hand, mounted to the base structure 5 by bearing joint arrangements 24. The balance actuators 9 are attached to the linear motion units 7 controlling the rotational pitch and roll movements by actively driven means 22. This arrangement provides free access to the working platform 4 from any place around e.g. when loading or discharging.

Figure 3:
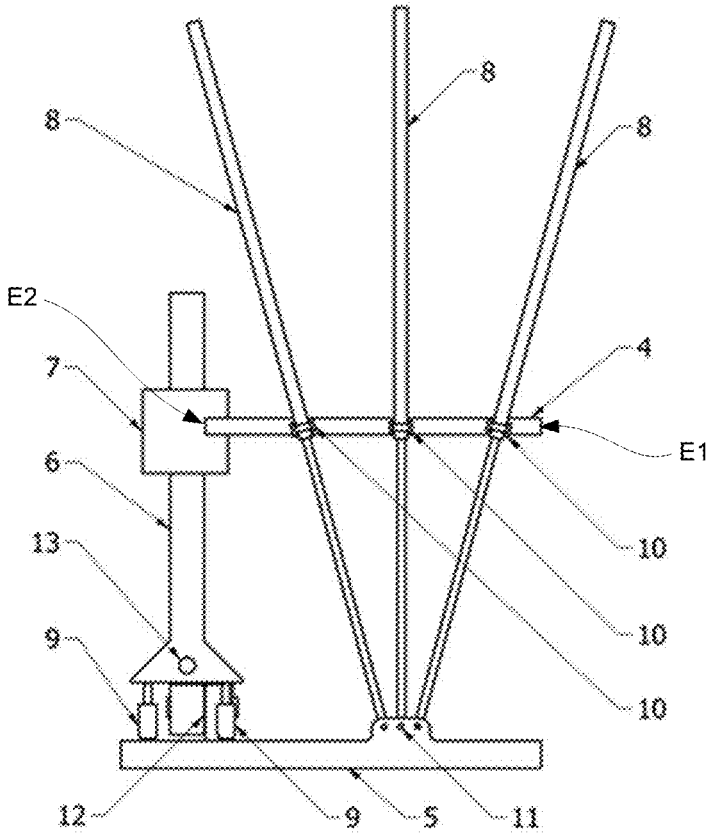
FIG. 3 is the side view of the system with the lifting actuators 8 in triangle-like arrangement.
Figure 4:
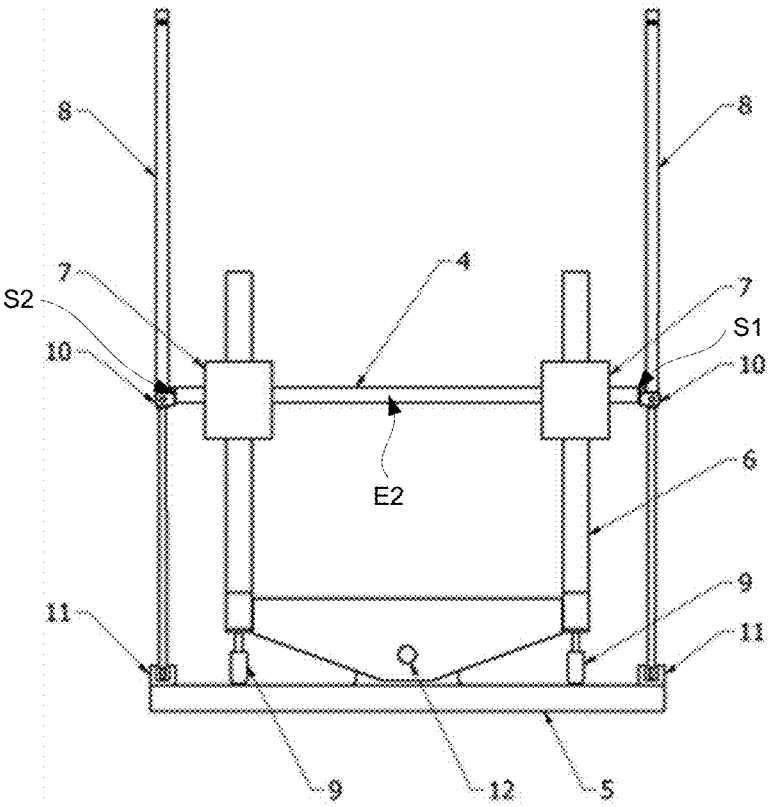
FIG. 4 is the front view of the system with balance actuators 9 attached to the working frame 6, visible in the foreground.

The rotational movements in pitch direction FIG. 3 with reference to FIG. 1, are measured by sensors 19 and processed through the control system 17. The control system 17 provides the means through conduits 22 to regulate pressures in the system. The pressure is controlled in all the balance actuators 9 which work actively. The same applies to the rotational movements in roll direction FIG. 4 with reference to FIG. 1, which are measured by the roll sensors 20.

With reference to FIG. 1, FIG. 5, FIG. 6 and FIG. 7 the set of the lifting actuators 8 (A-B) located towards the E1 are paired with the actuators 8 (C-D) towards E2. Whilst the piston from the actuator 8 is urged upwardly or downwardly, the compressed gas with the help of the accumulator/compressor assembly 14, is to be displaced from one side of the system to the other providing a stable working platform 4 in response to wave-induced motion of the whole vessel or floating structure 1, 1*a*.

The balance actuators 9 may be deactivated in case of need. In the event of a defect in the balance actuators 9 and/or the accumulator/compressor assembly 16, the control system 17 remains inactive. In such case, the triangular arrangement of the lifting actuators 8 as well as the substantially constant angle between the working platform 4 and the vertical beams of the working frame 6 and 6*b*, provides controlled pitch and heave directions. The balance process can be provided e.g. when the bearing joint arrangements 12 and 13 are mechanically locked and the lifting actuators 8 are operated by the fluid without gas through conduits 21 in order to flow between the paired actuators 8 (AB-CD), hence to keep the working platform 4 balanced.

Figure 5:
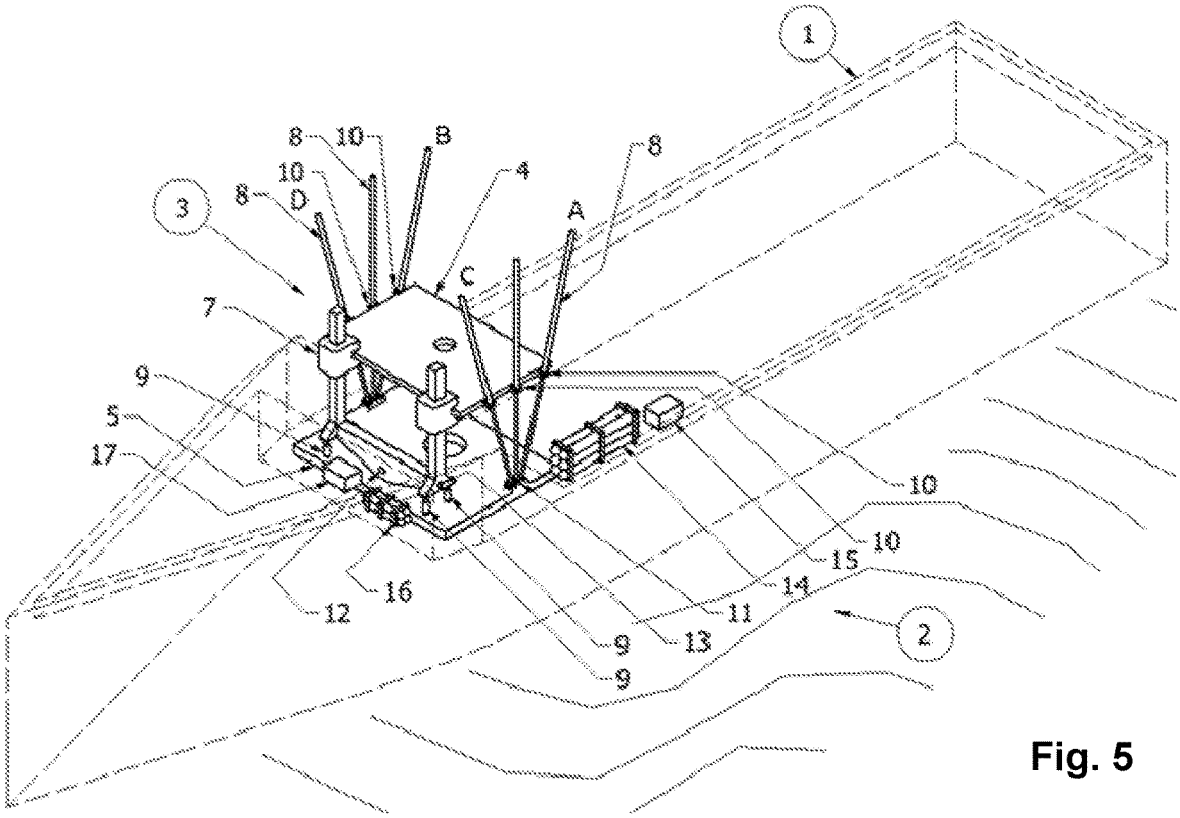
FIG. 5 is a perspective view of one embodiment illustrating the system with triangle-like arrangement of the lifting actuators 8, installed on a vessel.
Figure 6:
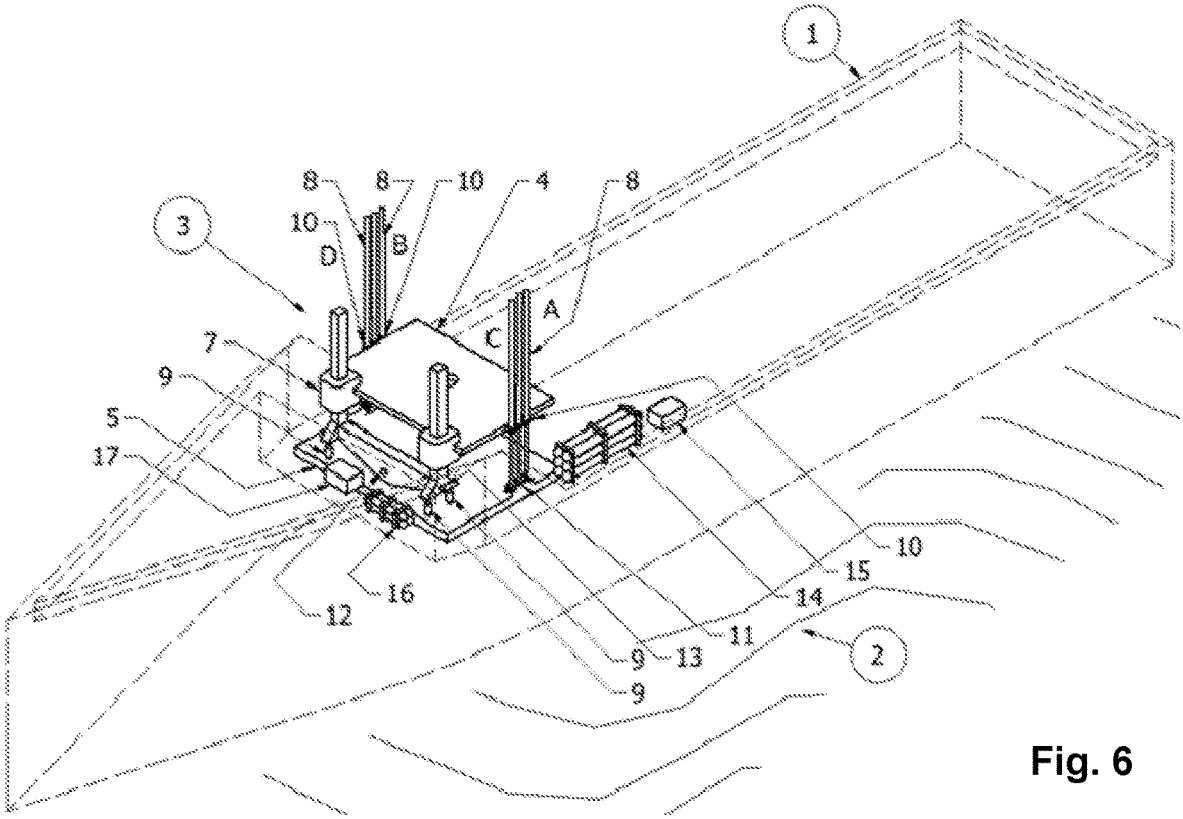
FIG. 6 is a perspective view of one embodiment having the system with parallel arrangement of the lifting actuators 8, installed on a vessel.

In another embodiment, with reference to FIG. 5 and FIG. 6, the motion compensated platform 3 is provided on a vessel 1 that floats on water 2. The motion compensated platform 3 is arranged with lifting actuators 8 which are actively or passively driven by means to hold a stable position of the working platform 4. Referring to FIG. 1, the compensation process is obtained by periodically driven pneumatic means 21 connected with a set of gas bottles of accumulator/compressor assembly 14, which passively absorbs a substantial part of wave motions. At the same time, the working frame 6 is balanced by actuators 9 which are actively driven by means 22. The control systems for the lifting actuators 8 and 9 operate independently ensuring measurements and processing of signals in an undisturbed manner. They may as well be driven by one or by two separate power units, depending on the needs of application. The first control system of the power unit 15 is responsible for processing signals from the heave sensors 18 and to provide continuous charge of pneumatic and hydraulic means to the lifting actuators 8 when the vessel 1 changes its position vertically. The second control system 17 processes signals from the pitch sensors 19 and the roll sensors 20 when the vessel 1 moves in other directions. The charging/discharging of means through conduits 22 is performed with the help of its own accumulator/compressor assembly 16 if needed, previously distributing the means through all the balance actuators 9.

In yet another embodiment, FIG. 6, the actuators 8 are arranged parallel to each other. The side of the platform 4, which is free of any equipment, can be utilized as e.g. the loading and discharging space for cargo. The range of motions, which can be compensated, is specified by the geometry of the arrangement including locations of all hinge points with the bearing joint arrangements 10, 11, 12 and 13.

In a preferred embodiment, the motion compensated platform 3 or 3*a* is provided on a vessel or floating structure 1, 1*a*, where it fulfills the role of a drill floor, with reference to FIG. 5, FIG. 6 and FIG. 7. As is well known, that in order to prevent the formation of stress in a pipeline or marine riser due to motions at sea, the whole drill-string should stay relatively steadily vertical. Since the riser cannot support itself in the water, the tension must be applied at its top to avoid buckling. The heave compensation systems, as additional equipment, are provided to maintain top tension relatively constant. These compensation systems require real-time output data of heave amplitude, velocity and acceleration which normally is provided by a motion reference unit, MRU, in terms of monitoring the vessel motions. In this particular embodiment, the lifting actuators 8 take over the role of motion compensation in heave direction and provide operability in a large range of motion with regards to the sea states. The changes of the upper and lower angle magnitudes of the riser can be measured by inclinometers, electronic and/or acoustic, and processed by the control system 15 in terms of buckling and to keep variations in the applied top tension as low as possible. At the same time, the sensing of changes in heave direction is performed by the heave sensors 18. The reference point for measured linear and angular variables of the vessel motion can be the output from MRUs which may be taken at several different points on that vessel.

In one embodiment, with reference to FIG. 1, FIG. 5, FIG. 6 and FIG. 7, the motion compensation platform 3, 3*a* may be utilized for drilling and related purposes, wherein the lifting actuators 8 may be driven passively in order to maintain a constant tension in riser string. In such case, an additional active heave compensation system with one or more extra actuators attached parallel to the lifting actuators 8 may be installed on the motion compensated platform 3, 3*a* as it is commonly used in modern technologies in order to reduce further the rest movement which is the result of external forces acting on the riser string below the water surface.

In another particular embodiment, the working platform 4 with reference to FIG. 1, FIG. 2, FIG. 5, FIG. 6 and FIG. 7, can provide a constant tension when the riser is connected to the seabed. In such case, the lifting actuators 8 are driven passively by means 21, and the tension on the riser is maintained by pressure of hydraulic fluid pressurized by gas through accumulator/compressor assembly 14. The gas volume is controlled by the control unit 15 to provide the desired stiffness of the system. In order to deliver the required tension, the gas pressure is either pumped or vented through the accumulator/compressor assembly 14 in response to increase or decrease the tension setting respectively. The selected gas volume and the pressure cause changes in the length of acting actuators 8—extending during downward movement of the vessel 1 or 1*a* or retracting when the vessel 1 or 1*a* moves upward on waves.

In another embodiment, the motion compensated platform 3 or 3*a* can be utilized for handling of cargo, such as precision machinery or military equipment, which is prone to damages with slight shock during transportation. Since cargo operations are affected by environmental conditions and mooring arrangements, a relatively stable deck area should be provided for such loads, especially when loading and/or off-loading from one floating structure to another. The motion compensation platform 3 or 3*a* can be provided, with reference whether to FIG. 1, FIG. 2, FIG. 5 or FIG. 7 for such operations. During the operation, lighter vessels are prone to large motions when near to a larger structure, whether fixed or floating one. In order to sustain a relatively stable deck, the control system 15 provides continuous charge of hydraulic and pneumatic means to the lifting actuators 8, whilst the balance actuators 9 are actively driven by the control system 17.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

To summarize: the system for compensation of motions of a self-leveling working platform which moves regardless of the floating structure, comprises:

a balance system, arranged to at least one side of a working platform 4, wherein a working frame 6 is supported by a plurality of actuators 9 attached between said frame 6 and a base structure 5;

a lifting system, wherein the working platform 4 is supported by a plurality of actuators 8 attached between said platform 4 and the base structure 5, and which is arranged slideably with the balance system by linearly moving motion units 7;

a plurality of arrangements of motion units 7 characterized in that the working platform 4 maintain a substantially constant angle relative to the working frame 6.

wherein the working frame 6, comprising a horizontal beam 6*a* which is connected either with vertical beams 6*b* or linear motion units 7;

a plurality of balance actuators 9, wherein the actuators are a selection of: hydraulic, pneumatic or electric actuators, or used as a combination of that, and wherein the actuator system comprises a set of cylinders, valves, sensors and supply lines for hydraulic, pneumatic and electric means.

The horizontal beam 6*a* is set on a bearing joint arrangement 12 providing rotation of said beam relative to one axis only. The horizontal beam 6*a* comprises two bearing joint arrangements 13 at its ends, providing rotation relative to axis perpendicular to the rotation axis of said beam 6*a*. The arrangements of linear motion units 7 are connected either with the working platform 4 in a rigid manner or with the horizontal beam 6*a* as rotatable ones relative to axis which is perpendicular to that beam 6*a*.

At least one linear motion unit 7 comprises at least one of the group of: housings, internal bearing frame, rolling members, sliding pads and guide bearings, and further comprising a self-lubrication system that provides lubricant for the sliding or rolling members.

The lifting system comprises:

the working platform 4 connected in a rigid manner either with the vertical beams 6*b* or the linear motion units 7;

a plurality of lifting actuators 8 arranged in two sets on two opposite sides of the working platform 4, whether in triangle-like or parallel configurations, wherein the actuator system comprises a set of hydraulic cylinders, valves, sensors and supply lines for hydraulic, pneumatic and electric means.

The working platform 4 comprises advantageously a plurality of bearing joint arrangements 10, 23 for the lifting actuators 8, providing multidirectional movement of said platform 4 relative to heave, pitch and roll axes, regardless of the floating structure 1, 1*a*.

Moreover, the actuators 8 are advantageously located towards E1 are paired with the actuators 8 towards E2, providing a self-leveling movement of the associated working platform 4 by pneumatic means with respect to each other.

The base structure 5 comprises advantageously a plurality of bearing joint arrangements 11, 12, 24 for the horizontal beam 6*a* and the actuators 8 from the lifting system, arranged either with their casings upwards or downwards.

The balance system with its actuators 9 for the working frame 4 is advantageously driven actively by hydraulic or a combination of hydraulic and pneumatic means.

The lifting system with actuators 8 for the working platform 4 may be driven actively or passively by hydraulic or a combination of hydraulic and pneumatic means.

In one embodiment, the actuators 8 from the lifting system, do not move all together in the same range of stroke length due to their configurations in terms of motions relative to heave, roll and pitch, enabling the working platform 4 to remain independent of the deck of the floating structure 1, 1*a*.

Contrary to the system described in WO 2011/008835 A2 mentioned in the background section of the description, the balance actuators 9 for pitch and roll disclosed herein are preferably driven actively. The working platform 4 supported by the lifting actuators 8 is not dependent on the deck of the vessel during normal operation and it may only be parallel to the deck either when the platform is in the park position, or the working frame 6 is mechanically locked, or there is no significant motion of the vessel. Furthermore, the lifting actuators 8 in the triangle-like configuration generate forces which act in heave and pitch. They as well move in roll but their movement is stabilized by the working frame 6, so they cannot be mounted rigidly to the vessel. Additionally, the lifting actuators 8 do not move all together in the same range since they are paired to balance themselves and yet the obtained horizontal position of the working platform 4 depends on the seabed or land. In this way, it is independent of the deck, which is contrary to the prior art heave stabilization system. Moreover, the working frame 6 including its vertical beams is mounted by bearing joint arrangements in order to provide pivotal movement, contrary to guide rails which are firmly attached to the vessel. Further, the working frame 6 is located on at least one side of the platform, not above or below, as stated in WO 2011/008835 A2 and it is balanced by actuators 9, and it is associated with the working platform 4 by linearly sliding motion units 7.

Contrary to the system described in WO 2013/180564 A1, the horizontal beam 6*a* of the working frame 6 is set on a bearing joint arrangement 12 that allows rotation around one horizontal axis only. No pivotal movement around the vertical axis is allowed. Hence, there are two vertical beams 6, 6*b* mounted at the ends of the horizontal beam 6*a* by separate bearing joint arrangements 13 allowing rotation in orthogonal axis. These two vertical beams 6, 6*b* are supported by own balance actuators 9 and arranged slideably with the working platform 4 by plurality of linear motion units 7, providing a constant angle between the working platform 4 and the vertical beams 6, 6*b*. The configuration of the lifting actuators 8 and the working frame 6, 6*a*, 6*b* supported by the balance actuators 9, provides a horizontal position of the working platform 4 according to the given reference points. In such case, the transverse pitch and the longitudinal roll displacements are at the same time compensated by two systems: the balance and the lifting ones.

Contrary to the system described in GB 2432174 B, the disclosed embodiments have two systems for lifting and balancing purposes. The balance actuators 9, supporting the working frame 6, 6*a*, 6*b* are charged by an active system, but they may as well be driven in an active/passive manner. Furthermore, as mentioned above, the vertical beams 6*b*, as well as the whole working frame 6 cannot be mounted or supported rigidly since they are intended to provide pivotal movement, thus they are supported by bearing joint arrangements 12, 13. As a result, the working platform 4 is independent of the vessel's deck. Additionally, the triangle-like configuration of the lifting actuators 8 supported by the balance actuators 9, keeps the working platform 4 horizontal relative to the seabed or land.

Contrary to the system described in WO 2004/013452 A1, the disclosed embodiments have their own guiding in a form of working frame 6 which is not limited by the vessel structure in its horizontal displacement, and the movement of which is balanced by actuators 9. The working frame 6 takes lateral forces and loads that arise while keeping the working platform 4 in horizontal position, and yet it provides pivotal movements.

The invention claimed is:

1. A system for keeping a substantially level working platform (4) in a desired position, said working platform (4) being arranged movable to a floating vessel (1) or floating structure (1*a*), with a lifting system comprising a set of elongate lifting actuators (8) connected pivotal to a base structure (5) and connected to the working platform (4) via numerous pivotal joints to compensate for pitch, roll and heave movements imposed by the floating vessel or structure (1, 1*a*), comprising (a) one or more sensors (18, 19, 20) for recording pitch, roll and heave movements; and (b) a working frame (6) having (i) first and second vertical beams (6*b*) with a horizontal beam (6*a*) extending between the first and second vertical beam (6*b*), (ii) two linear motion units (7) arranged slideably to the respective vertical beams (6*b*), (iii) a first upper end fixed to the working platform (4) and a second lower end connected movable to the base structure (5) by a balance system comprising set of balance actuators (9) and a pivotal joint (12), wherein said actuators (9) and pivotal joint (12) are arranged to tilt the working frame (6) in a desired angle to compensate for movements imposed by the floating vessel or structure (1, 1*a*) and maintain the working platform (4) in a desired position, and the working frame (6) is positioned on a second end (E2) of the platform (4) with an opposite first end (E1) of the platform (4) free from equipment and configured to be accessed for utilization of the platform.

2. The system of claim 1, wherein the set of balance actuators (9) includes two actuators connected to one of said linear motion units (7) and two other actuators connected to the other one of said linear motion units (7), wherein the horizontal beam (6*a*) is connected pivotal to the base structure (5) about a substantially horizontal axis by a joint arrangement (12), and further at its respective ends connected pivotal to the linear motion units (7) via pivotal joints (13).

3. The system of claim 2, wherein the balance actuators (9) comprise cylinder pistons driven by one or more of hydraulically and pneumatically by a compressor assembly (16) and supply lines (22), arranged to tilt the working platform (4) in a desired angle.

4. The system of claim 1, wherein the balance actuators (9) comprise cylinder pistons driven by one or more of hydraulically and pneumatically by a compressor assembly (16) and supply lines (22), arranged to tilt the working platform (4) in a desired angle.

5. The system of claim 1, wherein the one or more sensors comprises two or more pitch sensors (19) and two or more roll sensors (20) arranged at the base structure (5) at the respective sides (S1, S2) with respect to the working platform (4).

6. The system of claim 1, wherein the set of elongate lifting actuators (8) comprises a first pair (A, B) of co-operating actuators (8) arranged toward the first end (E1) of the working platform (4), each actuator (8) in the first pair (A, B) being arranged at an opposite first side (S1) and second side (S2) of said platform (4), and a second pair (C, D) of co-operating actuators (8) arranged toward the second end (E2) of the platform (4), each actuator (8) in the second pair (C, D) arranged at said opposite first side (S1) and second side (S2) of the platform (4), wherein said actuators (8) are connected to the working platform (4) by respective pivotal bearings (10) or (23), and connected pivotal to the base structure (5) by bearings (11) or (24), respectively to upward or downward mounting manner of said actuators (8).

7. The system of claim 6, wherein the actuator (A) and the actuator (C) at said first side (S1) are connected to a common lower point to the base structure (5) with their respective longitudinal axes extending parallel to one another in an upward direction, and the actuator (B) and the actuator (D) at said second side (S2) are connected to a common lower point to the base structure (5) with their respective longitudinal axes extending parallel to one another in an upward direction.

8. The system of claim 7, wherein the actuators (8) are cylinder pistons operated by one or more of hydraulically and pneumatically by a compressor assembly (14) and supply lines (21), arranged to move the working platform (4) in a vertical direction.

9. The system of claim 6, wherein each of the actuators (8) of each pair extend substantially parallel to one another.

10. The system of claim 9, wherein the actuators (8) are cylinder pistons operated by one or more of hydraulically and pneumatically by a compressor assembly (14) and supply lines (21), arranged to move the working platform (4) in a vertical direction.

11. The system of claim 6, wherein the actuators (8) are cylinder pistons operated by one or more of hydraulically and pneumatically by a compressor assembly (14) and supply lines (21), arranged to move the working platform (4) in a vertical direction.

12. The system of claim 1, wherein the actuators (8) are cylinder pistons operated by one or more of hydraulically and pneumatically by a compressor assembly (14) and supply lines (21), arranged to move the working platform (4) in a vertical direction.

13. The system of claim 1, wherein each elongate lifting actuator in the set of elongate lifting actuators is connected in a pivotal relationship to each of the base structure (5) and the working platform (4).

14. A method for compensation of motions of a self-leveling working platform installed on a floating structure by using the system according to claim 1, comprising the steps of:

a. checking the balance system and the position of working frame (6) when the system is powered on, b. checking the lifting system and moving the working platform (4) by the lifting actuators (8) with an active circuit to a start position, wherein steps (a) and (b) provide a measured displacement, c. moving the working frame (6) with the balance actuators (9) with an active circuit relative to the measured displacement, to maintain the vertical position of the system with regards to reference points, d. measuring motions of the system with the working platform (4) and the working frame (6) in rotational and translational movements with respect to reference points, e. driving sensor signals to the balance and lifting systems with regards to measured load variations, f. controlling the pressure and volume of fluid within the lifting actuators (8) and balance actuators (9) in the system via control units (15, 17) and with engagement of an accumulator/compressor assembly (14, 16) with regards to a self-leveling movement of the working platform (4) with paired lifting actuators (8) with reference to stern-bow location, g. controlling the actuators (8, 9) in the respective balance and lifting systems by generated sensor signals as responses to deviations from the desired positions, h. moving the working platform (4) by the lifting actuators (8) with an active or passive circuit relative to the measured displacement and the reference points, to remain horizontally positioned, regardless of the floating structure (1, 1*a*), i. moving the working frame (6) by the balance actuators (9) with an active circuit relative to the measured displacement, to maintain the vertical position of the system with regards to reference points, j. controlling the actuators (8, 9) in the lifting and balance systems and the working frame (6) position when the working platform (4) is lowered into a parking position, wherein the working frame (6) is positioned on a first side of the platform (4) with an opposite second side of the platform (4) free from equipment and configured to be accessed for utilization of the platform.

15. The method of claim 14, wherein the balance system can freely deviate from its position relative to the deck and which swings relative to its bearing joint arrangements (12, 13), does not lift and which takes only lateral forces that arise to keep the working platform (4) in horizontal position, providing an even distribution of weight enabling said platform (4) to remain upright and steady.

16. The method of claim 14, wherein the lifting system is configured to deviate regardless of the deck and the inclination of which is limited by the balance system, and which takes the forces arising in connection with the movement relative to translational heave axis.

17. The method of claim 14, wherein the plurality of arrangements of linear motion units (7) provide free linear movement of said platform (4) relative to said frame (6) regardless of the base structure (5) and the floating structure (1, 1*a*).

18. The method of claim 14, wherein each elongate lifting actuator in the set of elongate lifting actuators is connected in a pivotal relationship to each of the base structure (5) and the working platform (4).

* * * * *